US008126320B2

(12) United States Patent
Cartwright

(10) Patent No.: US 8,126,320 B2
(45) Date of Patent: Feb. 28, 2012

(54) METHODS FOR PREVENTING A DRY FIRE CONDITION AND A WATER HEATER INCORPORATING SAME

(75) Inventor: Kirby W. Cartwright, Dublin, OH (US)

(73) Assignee: Robertshaw Controls Company, Carol Stream, IL (US)

( * ) Notice: Subject to any disclaimer, the term of this patent is extended or adjusted under 35 U.S.C. 154(b) by 947 days.

(21) Appl. No.: 12/042,624

(22) Filed: Mar. 5, 2008

(65) Prior Publication Data

US 2009/0226155 A1 Sep. 10, 2009

(51) Int. Cl.
*F24H 1/20* (2006.01)
*F24H 1/18* (2006.01)

(52) U.S. Cl. ..... 392/451; 392/441

(58) Field of Classification Search ..... 392/441–464
See application file for complete search history.

(56) References Cited

U.S. PATENT DOCUMENTS 3,781,839 A 12/1973 Bodge
(Continued)

*Primary Examiner* — Daniel L Robinson
(74) *Attorney, Agent, or Firm* — Reinhart Boerner Van Deuren P.C.

(57) ABSTRACT

Methods of determining the likelihood of the existence of a dry fire condition in a hot water heater without requiring energization of any of the heating elements are presented. Such methods utilize only the sensor inputs required for normal operation of the hot water heater. Such sensory inputs are characterized in a process of fuzzification to enable the utilization of fuzzy logic rules to determine the likelihood of a dry fire condition before any energization of a heating element occurs. Alternatively, the sensory inputs are assigned logical values and are processed using Boolean logic to determine if a dry fire condition exists, prior to the energization of any electrical heating element within the hot water heater. Upon the determination that a dry fire condition is likely, the controller may perform a soft or hard lockout, may allow reset(s), and may provide an indication to the user of the condition.

10 Claims, 8 Drawing Sheets

U.S. PATENT DOCUMENTS

| | | | | |
|---|---|---|---|---|
| 3,789,190 | A | 1/1974 | Orosy et al. | |
| 3,909,588 | A | 9/1975 | Walker et al. | |
| 3,952,182 | A | 4/1976 | Flanders | |
| 4,535,931 | A | 8/1985 | Bartok et al. | |
| 4,638,147 | A | 1/1987 | Dytch et al. | |
| 4,789,407 | A | 12/1988 | Boiko | |
| 4,901,061 | A | 2/1990 | Twerdochlib | |
| 5,103,078 | A | 4/1992 | Boykin et al. | |
| 5,168,546 | A | 12/1992 | Laperriere et al. | |
| 5,318,007 | A | 6/1994 | Afshar | |
| 5,325,822 | A | 7/1994 | Fernandez | |
| 5,377,299 | A | 12/1994 | Anson et al. | |
| 5,442,157 | A | 8/1995 | Jackson | |
| 5,449,884 | A | 9/1995 | Lee | |
| 5,504,306 | A | 4/1996 | Russell et al. | |
| 5,586,214 | A | 12/1996 | Eckman | |
| 5,692,096 | A | 11/1997 | Massey et al. | |
| 5,706,390 | A | 1/1998 | O'Neil | |
| 5,723,846 | A | 3/1998 | Koether et al. | |
| 5,797,358 | A | 8/1998 | Brandt et al. | |
| 5,808,277 | A | 9/1998 | Dosani et al. | |
| 5,826,569 | A | 10/1998 | Voorhis | |
| 5,872,890 | A | 2/1999 | LaCombe | |
| 5,949,960 | A | 9/1999 | Hall | |
| 5,968,393 | A | 10/1999 | Demaline | |
| 6,053,130 | A | 4/2000 | Shellenberger | |
| 6,080,973 | A | 6/2000 | Thweatt, Jr. | |
| 6,137,955 | A | 10/2000 | Krell et al. | |
| 6,154,608 | A | 11/2000 | Rochelle | |
| RE37,240 | E | 6/2001 | Moore, Jr. et al. | |
| 6,265,699 | B1 | 7/2001 | Scott | |
| 6,308,009 | B1 | 10/2001 | Shellenberger et al. | |
| 6,350,967 | B1 | 2/2002 | Scott | |
| 6,355,913 | B1 | 3/2002 | Authier et al. | |
| 6,363,216 | B1 | 3/2002 | Bradenbaugh | |
| 6,455,820 | B2 | 9/2002 | Bradenbaugh | |
| 6,476,363 | B1 | 11/2002 | Authier et al. | |
| 6,546,897 | B1 | 4/2003 | Edds et al. | |
| 6,633,726 | B2 | 10/2003 | Bradenbaugh | |
| 6,646,237 | B2 | 11/2003 | Liu | |
| 6,649,881 | B2 | 11/2003 | Scott et al. | |
| 6,725,811 | B1 | 4/2004 | Moore, Jr. et al. | |
| 6,795,644 | B2 | 9/2004 | Bradenbaugh | |
| 7,027,724 | B2 | 4/2006 | Baxter | |
| 7,099,572 | B2 * | 8/2006 | Phillips | 392/459 |
| 7,103,272 | B2 | 9/2006 | Baxter | |
| 7,209,651 | B1 * | 4/2007 | Knoeppel et al. | 392/451 |
| 7,373,080 | B2 * | 5/2008 | Baxter | 392/454 |
| 7,706,670 | B2 * | 4/2010 | Knoeppel et al. | 392/451 |
| 2004/0177817 | A1 * | 9/2004 | Bradenbaugh | 122/13.01 |
| 2007/0177858 | A1 * | 8/2007 | Knoeppel et al. | 392/451 |
| 2007/0183758 | A1 * | 8/2007 | Bradenbaugh | 392/478 |

* cited by examiner

METHODS FOR PREVENTING A DRY FIRE CONDITION AND A WATER HEATER INCORPORATING SAME

FIELD OF THE INVENTION

The present invention relates generally to control systems for use with hot water heaters, and more particularly to protection methods for such hot water heaters specifically directed to the prevention of a dry fire condition occurring therein.

BACKGROUND OF THE INVENTION

A modern convenience enjoyed by most consumers is the ready availability of hot water for cooking, cleaning, and personal hygiene. To ensure an adequate supply of such hot water, many dwellings and commercial establishments utilize an electric water heater that includes a large water storage tank or reservoir in which are positioned electrical heating elements and temperature sensors. The water temperature to which the water heater heats and maintains the water temperature may be set by the consumer and is thereafter regulated by an onboard controller.

While smaller electric water heaters may only include a single heating element, many larger water heaters include two electrical heating elements vertically spaced apart from one another within the storage tank. To conserve space, most electric water heaters are configured as a cylindrical tank whose height greatly exceeds its diameter. In such a configuration, the electrical heating elements are typically spaced at two different vertical locations within the storage tank. In such a configuration, two temperatures sensors are typically used, and are placed above and proximate each heating element. As such, the individual temperature sensors can determine the localized temperature of the water proximate the individual heating elements.

Unfortunately, a significant problem that may occur with such electric water heaters is known as a dry fire condition. In a dry fire condition, the electrical heating elements are energized without being submerged in water, i.e. energized at a time when the water heater's storage tank is not filled. The design and construction of such electrical heating elements, however, can not withstand extended periods of energization without being submerged in water. Indeed, typically 10 seconds or longer of energization without being submerged will result in the electrical heating element reaching abnormally high temperatures that are significantly above standard operating temperatures experienced when the heating elements are submerged in water. These high temperatures are reached because no water is present to dissipate the heat generated by the heating elements as would occur when the hot water tank is filled with water.

As a result of these high temperatures, the electrical heating elements rapidly degenerate, and the useful life of the heating element is substantially reduced. It has been noted that energization in a dry fire condition for as little as 30 seconds may result in permanent failure of the heating element. Unfortunately, the occurrence of such situations is not uncommon, particularly during the installation of a new hot water heater if the installation personnel turns on the power to the hot water heater prior to completely filling the storage tank thereof.

In recognition of the serious nature of such a problem and the cost of replacing the heating elements, several approaches have been designed to preclude operation of the hot water heater if a dry fire condition would result. While water level sensors or other mechanisms could be employed to ensure the tank is full before energizing the electrical heating elements, the inclusion of such additional sensors and circuitry would drive up the cost of the hot water heater. This is unacceptable in the highly competitive consumer and commercial appliance market.

As such, many manufactures attempt to sense and prevent operation in a dry fire condition by utilizing the sensors required for normal operation of the hot water heater. These methods include utilizing the internal temperature sensors to sense the temperature proximate each heating element or temperature rise associated with each electrical heating element upon energization thereof. To limit the amount of damage that may be sustained to the electrical heating element until the onboard controller can determine that a dry fire condition exists, some methods utilize a pulse energization of the heating element. However, even in such systems damage to the electrical heating elements occur as the duration of energization must be sufficient to allow the temperature sensors to register a rise in temperature or other required parameter to allow the controller to differentiate a dry fire condition from a normal operating condition.

In view of the above, there exists a need in the art for a method of detecting a dry fire condition without stressing the electrical heating elements as part of the determination. Embodiments of the present invention provide such methods.

BRIEF SUMMARY OF THE INVENTION

In view of the above, embodiments of the present invention provide new and improved methods of detecting the presence of a dry fire condition. More particularly, embodiments of the present invention provide methods of detecting a dry fire condition without requiring energization of the electrical heating elements. Still further, embodiments of the present invention provide such methods without requiring the installation of additional sensors or circuitry not required for normal operation of the hot water heater.

In one embodiment of the present invention, the hot water heater's controller utilizes fuzzy logic to access the likelihood that a dry fire condition exists based on normally sensed inputs required for normal operation of the hot water heater. Such determination may be made immediately after power up of the electronic control. Such a method is passive, using only sensor inputs, temperature set points, and the controller's history to determine the likelihood that a dry fire condition exists.

In one embodiment of the present invention, the determination of the likelihood of a dry fire condition relies on the upper and lower water tank temperatures, the temperature setting, and the ambient temperature. In one embodiment a fifth input, water inlet temperature, may also be used in the determination of the likelihood of a dry fire condition. A nonphysical input may also be used in this determination. In one embodiment this nonphysical input is the run time hours of the controller.

The inputs are then categorized through a process of fuzzification. This fuzzification converts the actual sensor and other inputs from crisp, well-defined inputs to fuzzy or loosely defined inputs whose value ranges from zero to one. These fuzzy values are then compared using various rules to determine whether a dry fire condition is likely or unlikely to be existing prior to energization of the electrical heating elements.

In one embodiment, the inputs are not characterized into fuzzy values ranging from zero to one, but instead are converted to logical values of zero or one. Boolean logic is then utilized to determine the likely existence of a dry fire condition.

Embodiments of the present invention also provide a hot water heater including an electronic controller, at least one heating element, at least one temperature sensor positioned in proximity to the heating element, and a controller that is programmed to determine the likelihood of a dry fire condition existing at power up without energizing the electrical heating element. In one embodiment the controller characterizes the sensor inputs in a process of fuzzification and applies fuzzy logic rules to determine the likelihood of the existence of a dry fire condition before energizing any of the heating elements contained therein. In another embodiment, the controller assigns logical values to the sensor inputs and utilizes Boolean logic to determine whether a dry fire exists without energizing any of the heating elements.

Other aspects, objectives and advantages of the invention will become more apparent from the following detailed description when taken in conjunction with the accompanying drawings.

BRIEF DESCRIPTION OF THE DRAWINGS

The accompanying drawings incorporated in and forming a part of the specification illustrate several aspects of the present invention and, together with the description, serve to explain the principles of the invention. In the drawings.

While the invention will be described in connection with certain preferred embodiments, there is no intent to limit it to those embodiments. On the contrary, the intent is to cover all alternatives, modifications and equivalents as included within the spirit and scope of the invention as defined by the appended claims.

DETAILED DESCRIPTION OF THE INVENTION

Figure 1:
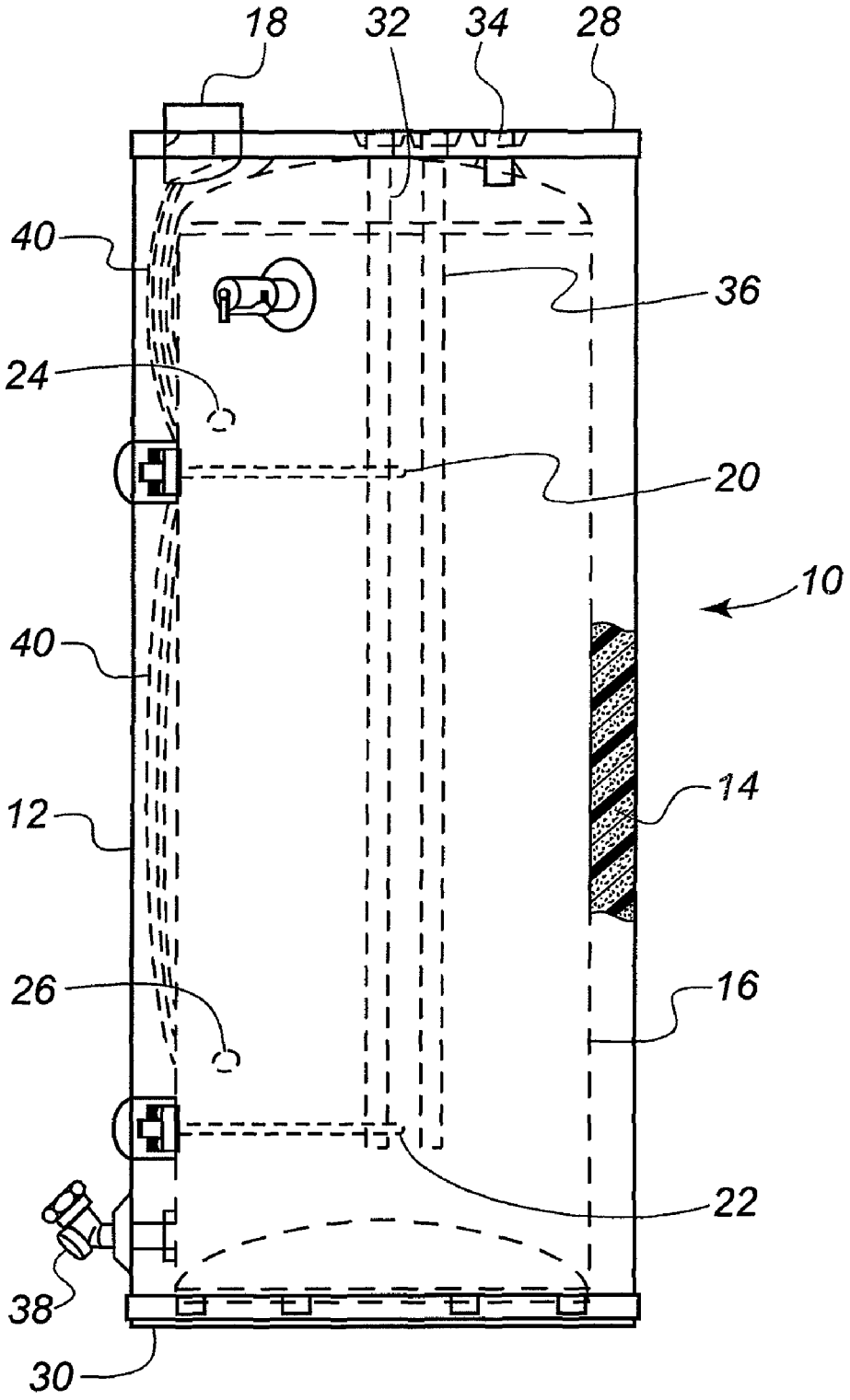
FIG. 1 is a simplified illustration of a consumer hot water heater constructed in accordance with an embodiment of the present invention.

Turning now to the drawings, there is illustrated in FIG. 1 an exemplary embodiment of an electric water heater 10 constructed in accordance with the teachings of the present invention. It should be noted, however, that while the foregoing and following description discuss one application of the teachings of the present invention as applied to an electric water heater appliance, the methods described are also applicable to other implementations of electric heating elements for use in liquids, e.g. coffee makers and coffee vending machines. As such, the following description should be taken by way of example and not by way of limitation. With this in mind, the general construction and operation of the water heater 10 will now be briefly described to provide a context for understanding the principles of embodiments of the present invention.

The water heater 10 comprises an outer body 12, a layer of insulation 14, a tank 16, a controller 18, an upper heating element 20, a lower heating element 22, an upper temperature sensor 24 and a lower temperature sensor 26. Other, typically smaller water heaters may only include a single heating element and temperature sensor as is recognized by those skilled in the art. The outer body 12 protects and surrounds the layer of insulation 14 that prevents heat from dissipating from the tank 16. The layer of insulation 14 is preferably a layer of foam insulation, but it can be constructed from any other thermal insulator. The tank 16 holds the water to be heated and is typically constructed from a metal. The controller 18 selectively energizes the upper and lower heating elements 20, 22 in response to temperature information gathered from the upper and lower temperature sensors 24, 26 to maintain a desired, typically user set water temperature.

The outer body 12 of the water heater 10 is capped by a top pan 28 on a top end and capped by a bottom pan 30 at a bottom end. The water heater 10 includes an inlet 32 for cold water to enter the tank 16 and an outlet 34 for hot water to exit the tank 16. It will be appreciated that cold water generally exits the inlet 32 proximate the bottom of the tank 16 and the hot water will generally be drawn into the outlet 34 proximate the top of the tank 16. The water heater 10 further includes an anode rod 36 extending vertically within the tank 16 to help prevent corrosion of the tank 16. A spigot 38 at the lower end of the tank 16 allows the tank 16 to be drained.

The upper and lower heating elements 20, 22, which may be any commercially available heating elements, are vertically spaced apart from one another and mounted to the side of the outer body 12 and tank 16 by either bolting or threading. The upper heating element 20 has a corresponding upper temperature sensor 24 positioned vertically above the heating element 20 for sensing the temperature of the localized environment proximate the upper heating element 20. Likewise, the lower heating element 22 has a corresponding lower temperature sensor 26 positioned vertically above the lower heating element 22 for sensing the temperature of the localized environment proximate the lower heating element 22. The temperature sensors 20, 22 are preferably thermistors. The upper and lower heating elements 20, 22 and upper and lower temperature sensors 24, 26 are connected to the controller 18 by wires 40. The wires are located between an inner surface of the outer body 12 and the outer surface of tank 16. In other embodiments, not shown, the controller 18 can be in wireless communication with the temperature sensors 24, 26.

The controller 18 preferably incorporates electronic control circuitry for controlling operation of the water heater 10. Such circuitry may incorporate a number of electronic components, known to those of ordinary skill in the art, such as solid state transistors and accompanying biasing components, relays, and/or one or more equivalent, programmable logic chips. The electronic control circuitry may also incorporate programmable read only memory, or random access memory and a microprocessor. In a preferred embodiment, the controller 18 also includes an ambient temperature sensor (not shown), the use of which is later described. Such temperature sensors may be implemented from a number of electronic components, known to those of ordinary skill in the art, such as thermistors, thermocouples, diodes, etc. In one embodiment, the controller 18 also includes a reset switch (not shown). This reset switch may allow the operator to bypass the tests described in the following, or to recover from hard lockouts as described more fully below. Such reset switches may be implemented from a number of electronic components, known to those of ordinary skill in the art, such as jumpers, DIP switches, pushbuttons, etc.

Figure 2:
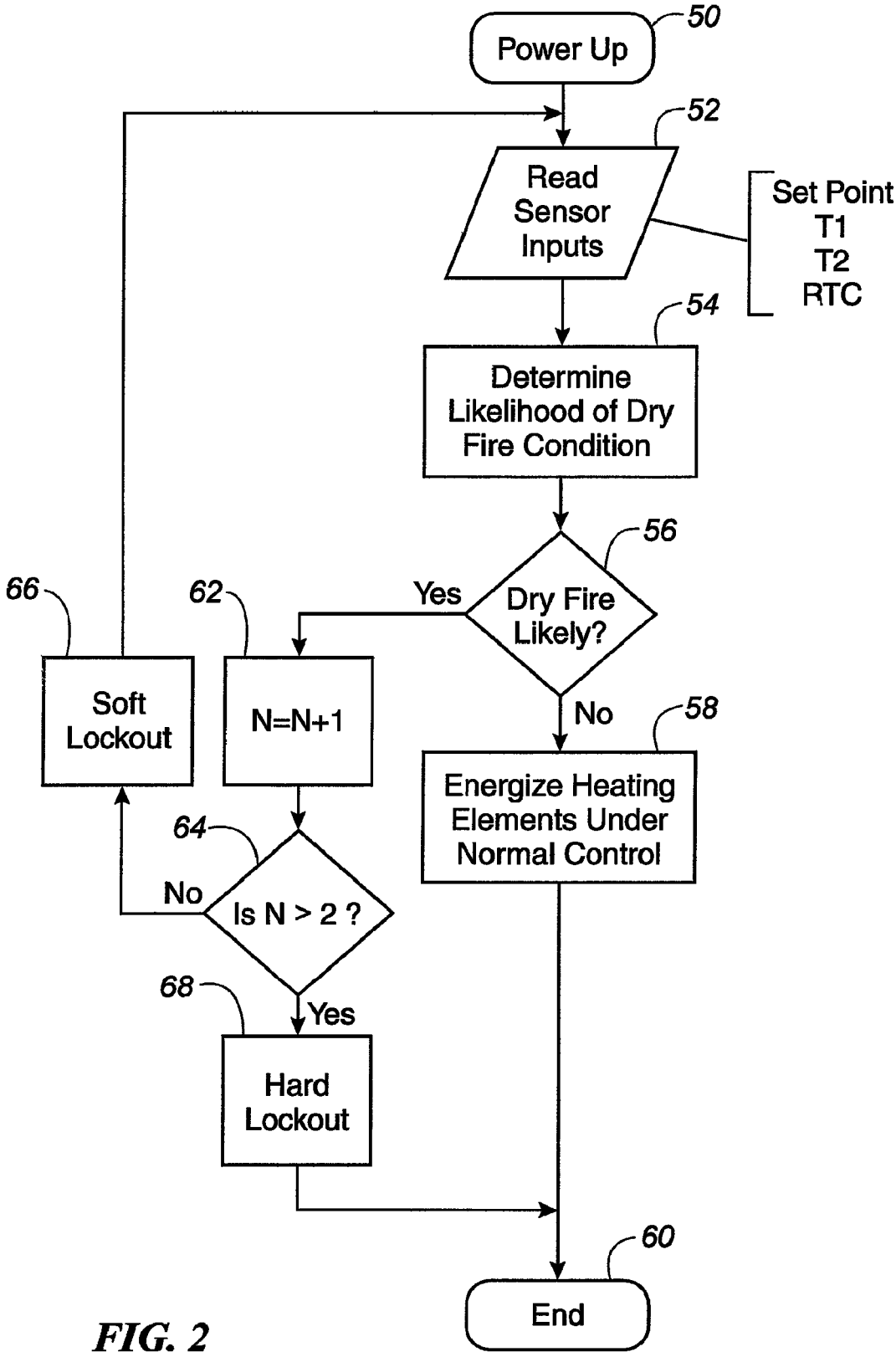
FIG. 2 is a simplified process flow diagram illustrating an embodiment of a method of the present invention.

With an understanding of one exemplary embodiment of a water heater to which methods of the present invention are particularly applicable, attention is now directed to FIG. 2 wherein is illustrated a simplified process flow diagram of an embodiment of a method for determining the likelihood of a dry fire condition should at least one of the heating elements 20, 22 be energized. In practice, the following methods may be implemented in, for example, the controller 18 of the hot water heater 10 or other appropriate circuitry employed for the control or protection of the appliance. Such implementation may be via hardware, firmware or software, including implementations that utilize programmable logic arrays (PLAs), programmable logic devices (PLDs), in the operative program contained in software or firmware run on a microprocessor or microcontroller, etc. Indeed, the inventive features of embodiments of the present invention are not limited to any particular implementation, and therefore the full scope of the claims appended hereto are hereby reserved.

As illustrated in FIG. 2, upon power up 50 or otherwise at initiation an embodiment of the present invention reads the various sensor inputs at block 52, such as the set point, multiple temperature sensor inputs (T1, T2), the run time clock (RTC) if provided, etc. Depending on the implementation, fewer or more sensory inputs as well as programming or operational inputs may be used. For example, in a smaller fluid heating application, there may only be a single heating element and associated temperature sensor, no run time clock, etc. Regardless of the physical embodiment into which this embodiment is included, one advantage provided by this method is that no sensors other than those required for normal operation of the heating appliance need be utilized to determine the likelihood of the existence of a dry fire condition should at least one of the heating elements 20, 22 be energized.

Once the available sensor inputs have been read or otherwise become known, the illustrated embodiment then determines the likelihood of the existence of a dry fire condition should at least one of the heating elements 20, 22 be energized at functional block 54. If the method determines that a dry fire condition is not likely at decision block 56, the appliance control or controller may then energize the heating element or elements under normal operational control as illustrated at block 58 before the process ends 60. It should be noted that this energization at block 58 only occurs if decision block 56 determines that a dry fire condition is not likely to exist. In other words, and unlike prior methods, no energization of the heating elements is required to make the determination whether a dry fire condition exists or not. This provides a significant advantage over such prior methods that required one or more of the heating elements to be energized for a short period of time to determine whether or not a dry fire condition existed. As discussed above, such prior methods could result in damage or degradation of the life of the various heating elements as energization thereof was required before a determination of whether a dry fire condition existed or not. No such predetermination energization is required by the method illustrated in FIG. 2.

Returning to decision block 56, if it is determined that a dry fire condition is likely to be in existence should at least one of the heating elements 20, 22 be energized, one embodiment indexes or otherwise counts this determination at block 62 as a control mechanism to allow a certain number of restart attempts before maintenance is required. As illustrated in FIG. 2, decision block 64 checks whether the predetermined number of restarts has occurred. The embodiment illustrated in FIG. 2 allows for two restarts before maintenance is required, although those skilled in the art will recognize that fewer or more attempts may be provided as desired. Indeed, since the illustrated method does not require actual energization of the heating elements prior to making the determination whether a dry fire condition is likely should at least one of the heating elements 20, 22 be energized, allowing multiple restarts will not result in damage to the heating elements whatsoever. In recognition of this, blocks 62 and 64 may be eliminated in alternate embodiments of the present invention to allow unlimited restarts.

In the illustrated embodiment, if the number of restarts has not exceed the preset limit as determined by decision block 64, the system enters a soft lockout operation at block 66 before cycling to again read the sensor inputs at block 52. In one embodiment of the present invention, the soft lockout 66 flashes or displays an appropriate display pattern or message depending on the particular implementation of the controller 18 (see FIG. 1). In a wired or smart home configuration wherein the various appliances can communicate with a home diagnostic control system, an appropriate message may also be communicated therewith.

This soft lockout operation may also include a delay period before allowing a restart attempt. This delay period may be particularly useful during the initial installation of the hot water heater when service personnel often energize the hot water heater before the hot water tank has had an opportunity to be completely filled. In such a case, waiting a predetermined period of time, e.g. 15 minutes, will give the hot water heater enough time to fill to a point where a dry fire condition is no longer likely to occur. This predetermined time may be varied as desired or based upon the hot water heater tank size, fill rate, etc.

In the embodiment illustrated in FIG. 2, once the two automatic restart attempts have been completed and yet decision block 56 still indicates that a dry fire condition is likely to exist should at least one of the heating elements 20, 22 be energized, decision block 64 will send the system into a hard lockout at block 68. In one embodiment this hard lockout will cause the control to prohibit energization of the heating elements and will require a service call to investigate the source of the continuing problem. In embodiments of the present invention, appropriate fault messages or codes may be displayed or otherwise communicated to the appliance owner. If the particular embodiment includes automatic maintenance scheduling functionality, this hard lockout may also generate a maintenance request to schedule a service call to address the dry fire condition.

Figure 3:
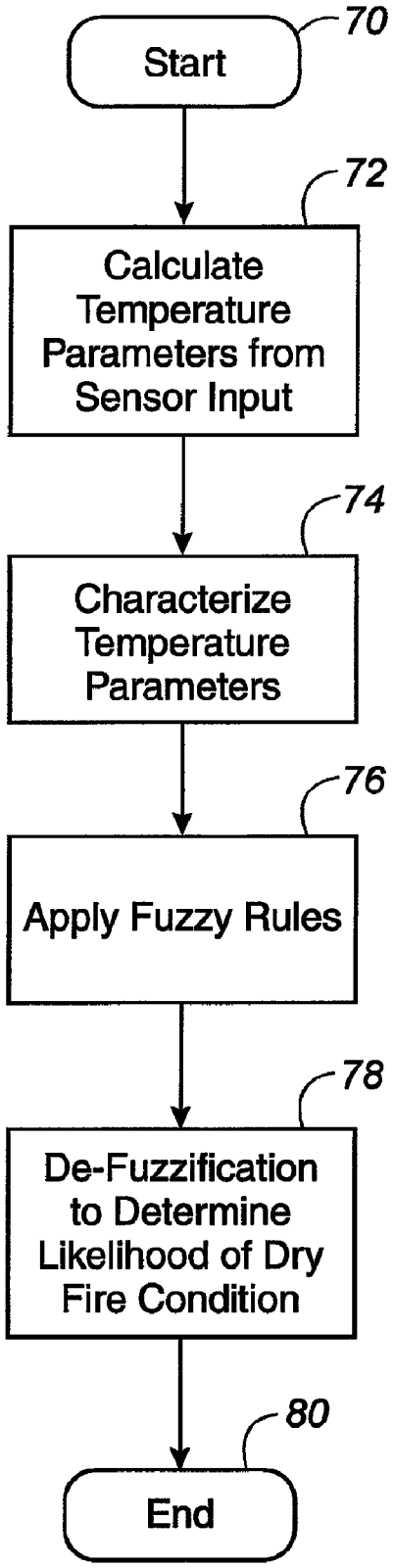
FIG. 3 is a simplified process flow diagram illustrating an aspect of the process of FIG. 2 utilizing fuzzy logic.

Turning now to FIG. 3, there is illustrated a simplified flow diagram of an embodiment of process block 54 illustrated in FIG. 2. That is, FIG. 3 illustrates one embodiment of the method to determine the likelihood of the existence of a dry fire condition should at least one of the heating elements 20, 22 be energized. Once this process has begun 70, this embodiment calculates various temperature parameters from the sensor inputs read by block 52 of FIG. 2 in process block 72. As discussed above, these sensor inputs may include the upper and lower temperature sensor inputs, the temperature set point, possibly the ambient temperature, and possibly the water inlet temperature depending on the configuration of the particular water heater. The other input parameter that may be utilized if available is the run time hours of the controller and/or a time of day input. Also, as discussed above, for a single heating element system, there may be only one temperature sensor input.

From these various inputs, process block 72 calculates various parameters that will be utilized in later processing to determine the likelihood that a dry fire condition exists within the water heater should at least one of the heating elements 20, 22 be energized. These parameters may include a delta temperature between the two tank temperature sensor inputs, a delta temperature between each of the tank temperature sensors and the ambient temperature sensor as well as, in other embodiments of the present invention that utilize a power up delay or that have entered through a soft lockout process, a delta temperature between the initial tank temperature sensor reading and the current tank level temperature reading.

Once the temperature parameters have been calculated in block 72, a characterization of these temperature parameters as well as the sensor readings themselves occurs in functional block 74. This characterization or categorizing of the inputs is frequently called fuzzification. This is the process for converting crisp or well defined inputs to fuzzy or loosely defined inputs. An input that is fully in a category has a logical value of one. Similarly, an input that is fully out of the category produces an output of logical value zero. However, in between these two well defined points the input value is assigned a value between logical zero and logical one. As will be discussed more fully below, the range of the input is fully defined from a minimum to a maximum, which aids in normalizing the inputs.

To understand the rationale for providing such fuzzification, an example of consumer perception of what defines cold water will be discussed. One customer believes that the definition of cold water varies greatly by climate and season. As a generic, 61° to 63° Fahrenheit would be considered cold in summer and fall, while in winter and early spring water is perceived to be cold when it is 55° and 58° Fahrenheit. However, if the water under consideration is from a well or a northern climate, these ranges may be quite a bit colder. To another customer however, water is not viewed to be "cold" unless it is at approximately at 40° Fahrenheit.

Figure 5:
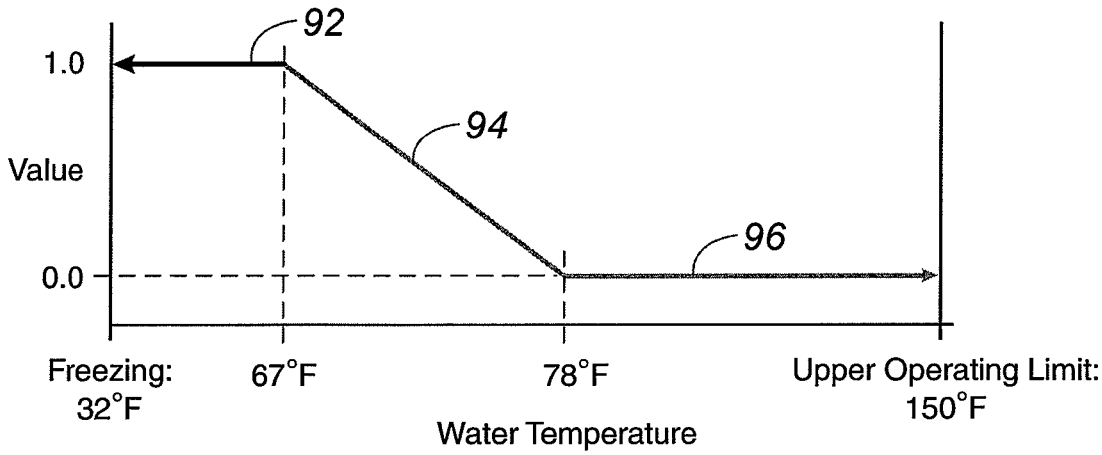
FIG. 5 is a fuzzification graph constructed in accordance with an embodiment to the present invention illustrating fuzzification of water temperature inputs to determine if the water temperature is cold.

As these responses illustrate, there is no exact temperature at which one could clearly determine if the tank is full of cold water. As such, in one embodiment of the present invention, the temperature range that determines cold water starts loosely at 72° Fahrenheit and decreases. Therefore, as illustrated in FIG. 5, one embodiment of the present invention characterizes a "cold water" temperature parameter from 32° to 67° Fahrenheit as an output value of logical one illustrated by segment 92 of FIG. 5. Water temperatures from 68° Fahrenheit to 77° Fahrenheit produces a value that ranges from one to zero as illustrated by segment 94. As segment 96 illustrates, from 78° Fahrenheit to the upper operating limit produces a value of zero for the cold water temperature determination.

It should be noted that while a linear relationship of segment 94 is illustrated in the embodiment of FIG. 5, various other relationships, including linear, curvilinear, piecewise linear, non-linear, exponential, other function, etc. may be utilized depending on the level of confidence or uncertainty that may attach to the various temperature readings to determine whether or not the water is "cold". These differencing functions may be selected based on various parameters, including area of the country, whether the water heater is hooked to a well or a municipal water supply, the time of year, etc. In the limit, as the level of confidence of whether the water is cold rises to certainty, the graph approaches that used in the Boolean embodiment of the present invention illustrated in FIG. 9. However, in the current embodiment under discussion, the level of confidence of the read value being characterized as cold or not has not reached the level of certainty, and therefore fuzzification over at least a portion of the operating limits of the temperature sensor is required.

While the embodiment of FIG. 5 utilizes fixed points for the transition between segments 92, 94 and 96, those points may be varied in temperature without departing from the sphere and scope of the invention, and therefore the recited values for those transition points should not be taken as limiting.

Figure 6:
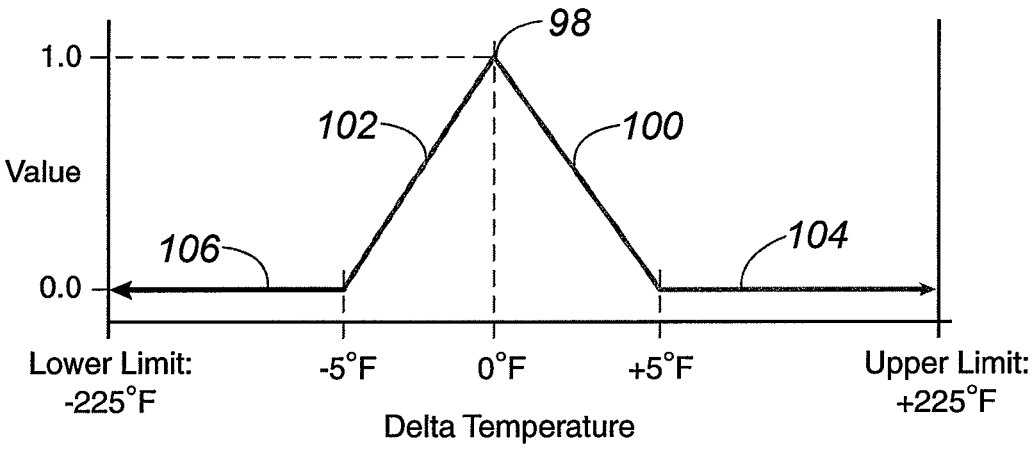
FIG. 6 is a fuzzification graph constructed in accordance with an embodiment to the present invention illustrating fuzzification of water temperature inputs to determine if the temperature differential is close.

Another temperature parameter that may be characterized is illustrated in FIG. 6. As shown, FIG. 6 illustrates the fuzzification of the delta temperature reading to determine whether or not the two tank temperature sensor are close to one another or not. In the illustrated embodiment, a temperature difference of zero has a value of one at point 98. A temperature difference of from plus or minus 5° Fahrenheit to 0° Fahrenheit, as illustrated by segments 100, 102 is characterized to a value from zero to one. A temperature difference of plus or minus 10° Fahrenheit illustrated by segments 104, 106 is characterized as a value zero. As discussed above, while FIG. 6 illustrates a linear relationship for segments 100, 102, this characteristic may be changed depending on the level of confidence that a certain temperature differential is "close" or not.

Figure 7:
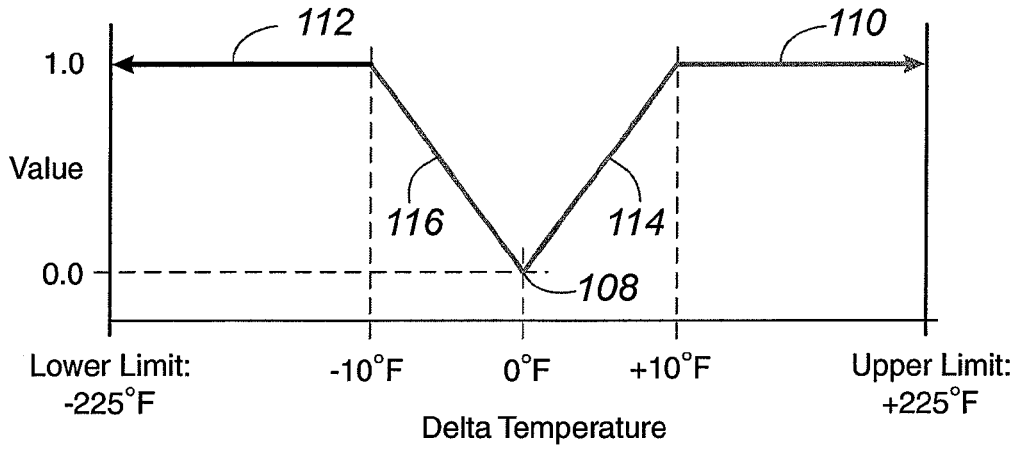
FIG. 7 is a fuzzification graph constructed in accordance with an embodiment to the present invention illustrating fuzzification of water temperature inputs to determine if the temperature differential is far.

A similar but opposite characterization graph of the temperature parameter for determining whether the two temperature readings are far from one another is illustrated in FIG. 7. As shown, a temperature difference of 0° Fahrenheit is assigned a value of zero at point 108. A temperature difference of plus or minus 10° Fahrenheit results in a value of one as illustrated by segments 110, 112. However, between these "certain" values, the delta temperature is assigned a value from zero to one for a temperature difference between plus or minus 5° as illustrated by segments 114, 116. As discussed above, the linear relationship illustrated for segments 114 and 116 may take other forms for the reasons set forth above.

Figure 8:
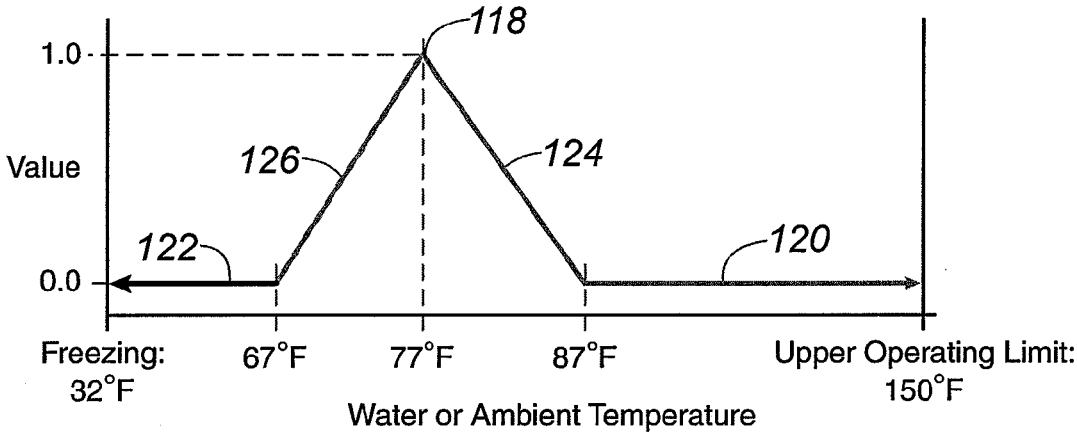
FIG. 8 is a fuzzification graph constructed in accordance with an embodiment to the present invention illustrating fuzzification of water temperature inputs to determine if the water or ambient temperature is at room temperature.

FIG. 8 illustrates the characterization or fuzzification graph for the temperature parameter "room temperature." In the illustrated embodiment, a temperature of 77° Fahrenheit leads to a value of one at point 118. A difference from this temperature of greater than 10° Fahrenheit leads to a value of zero as illustrated by segments 120 and 122. Between these, segments 124, 126 illustrate a linear assignment of a value between zero and one. As discussed above, the linear relationship illustrated for segments 124, 126 may take on other forms. Similarly, as with all of the proceeding temperature set points used in the exemplary illustrations, a particular set point may also be varied without departing from the scope of the invention, and are instead provided by way of example for one embodiment of the present invention.

Returning to the process flow diagram of FIG. 3, after the various temperature parameters have been characterized in functional block 74, functional block 76 applies fuzzy logic rules to the various characterized inputs. In applying the fuzzy logic rules, "unlikely" means a value closer to zero, while "likely" means a value closer to one. As such, this embodiment of the present invention that utilizes fuzzy logic seldom determines with absolute certainty that a dry fire condition exists should at least one of the heating elements 20, 22 be energized or not, and instead calculates whether a dry fire condition is likely to occur should at least one of the heating elements 20, 22 be energized or is unlikely to occur at the present time. The level of confidence of this determination may be increased in one embodiment by utilizing more than one of the fuzzy rules to be discussed more fully below to hone in on a determination of whether a dry fire condition is likely or unlikely to occur should at least one of the heating elements 20, 22 be energized.

In one such fuzzy rule, if the difference between the two tank temperatures indicates that they are close and they are not at room temperature and they are cold then a dry fire condition is unlikely. If, however, the two tank temperatures are merely close, then dry fire is likely should at least one of the heating elements 20, 22 be energized. If the two tank temperatures are close to freezing then dry fire is also determined to be likely should at least one of the heating elements 20, 22 be energized. However, if the two tank temperatures are close to the set point temperature then a dry fire is unlikely. If the upper, lower, and ambient temperatures are close then a dry fire is likely should at least one of the heating elements 20, 22 be energized because the tank is probably empty and at ambient temperature. If the run time hours is large, then a dry fire condition is unlikely based on the premise that the tank has been on and full and operating correctly for a long period of time, and therefore a dry fire condition at this point is unlikely. Similarly, if the two tank temperatures are close to the history then a dry fire is unlikely. A history requires a time of day clock including possibly a hardware RTC and a place to store data such as a memory element, e.g. an EEPROM. However, if the two tank temperatures are at room temperature then a dry fire is likely should at least one of the heating elements 20, 22 be energized.

Once the fuzzy rule or rules have been applied in functional block 76, this embodiment of the method of the present invention combines the rule outputs using defuzzification to determine the likelihood of a dry fire condition should at least one of the heating elements 20, 22 be energized at functional block 78. The process of defuzzification, that is the mathematical combination of the outputs of the above rules, is well known in the art of fuzzy logic, and will not be discussed in detail herein. For example, it is known that when using fuzzy logic the "and" function is replaced with set theory's intersection operation. Once the defuzzification process is complete, this process ends 80 and the output is passed to the decision block 56 of FIG. 2.

Figure 4:
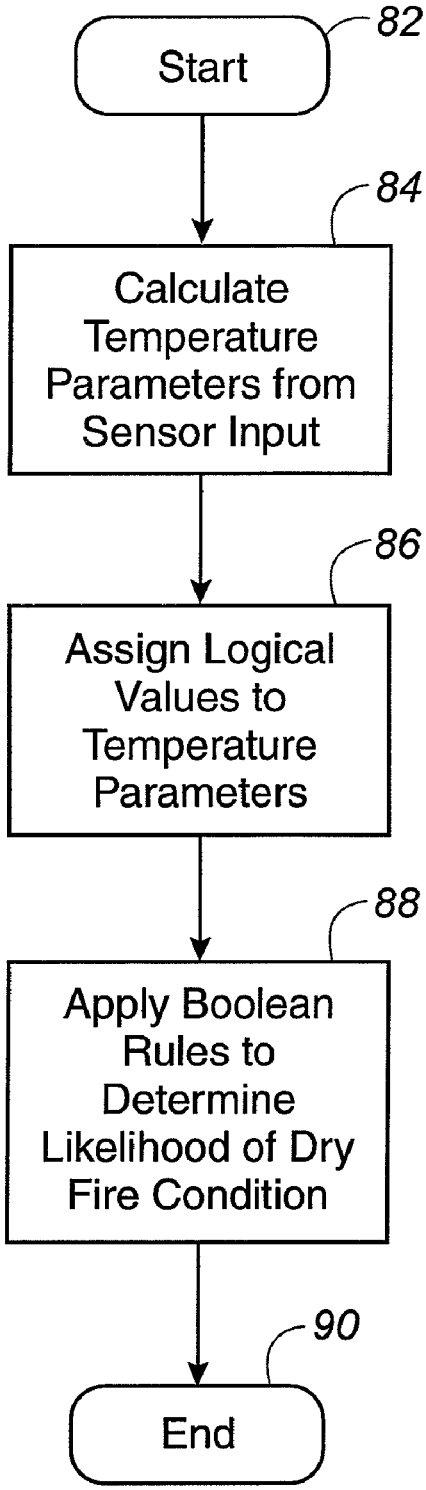
FIG. 4 is a simplified process flow diagram illustrating an aspect of the process flow of FIG. 2 utilizing Boolean logic.

In an alternate embodiment of the present invention, the operation preformed in functional block 54 of FIG. 1 to determine the likelihood of a dry fire condition should at least one of the heating elements 20, 22 be energized is as illustrated in FIG. 4 to which reference is now made. Once this process starts 82, the temperature parameters from the sensor inputs are calculated at functional block 84. In this embodiment of the present invention, the same or similar temperature parameters may be calculated as discussed above with regard to the embodiment illustrated in FIG. 3. These temperature parameters may be a cold water temperature parameter, whether the temperature readings are close or far, whether the temperature values are at room temperature, etc.

Figure 9:
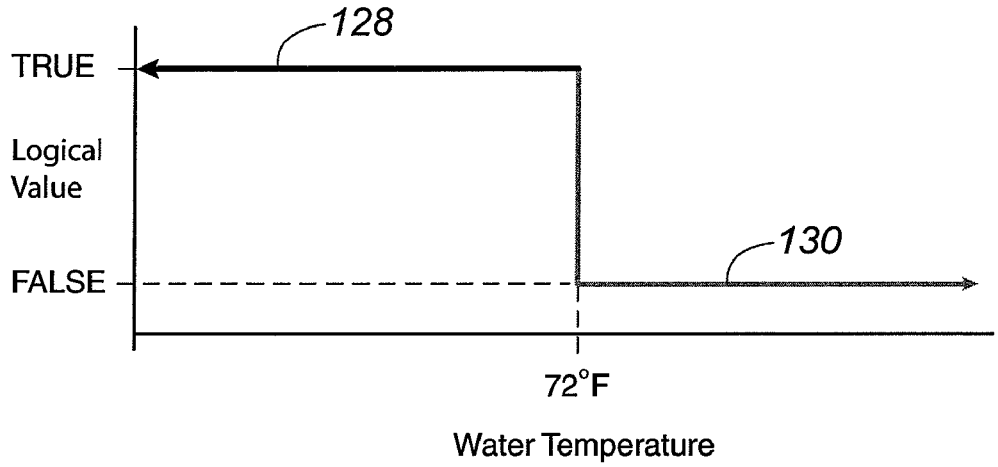
FIG. 9 is a Boolean logic graph constructed in accordance with an embodiment to the present invention assigning logical values to determine if the water temperature is cold.
Figure 10:
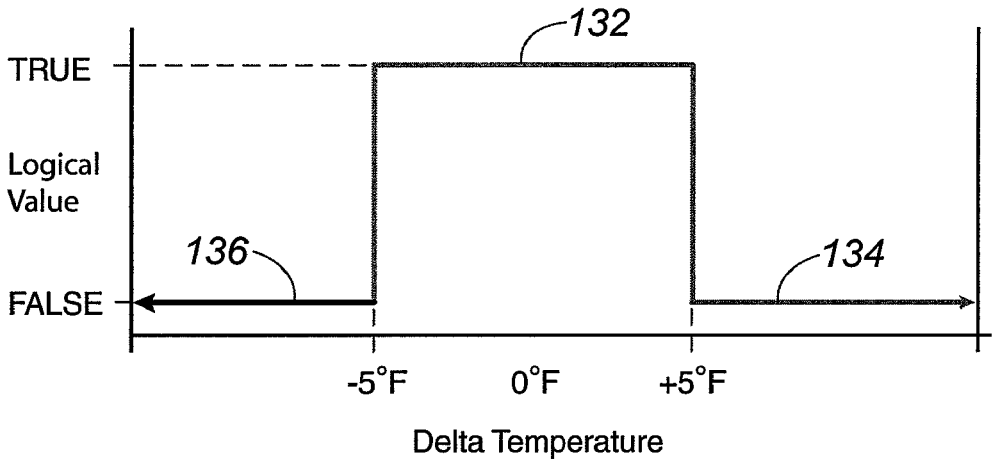
FIG. 10 is a Boolean logic graph constructed in accordance with an embodiment to the present invention assigning logical values to determine if the water temperature difference is close.
Figure 11:
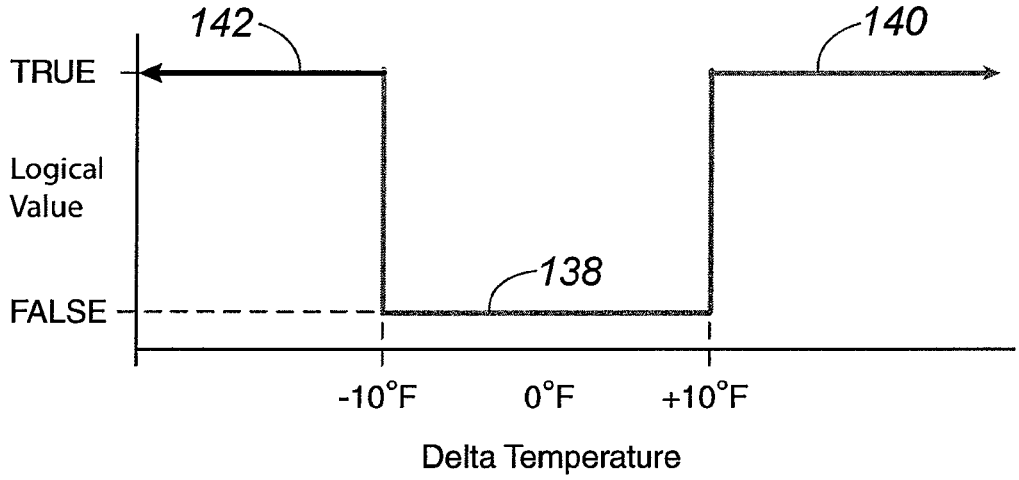
FIG. 11 is a Boolean logic graph constructed in accordance with an embodiment to the present invention assigning logical values to determine if the water temperature difference is far.
Figure 12:
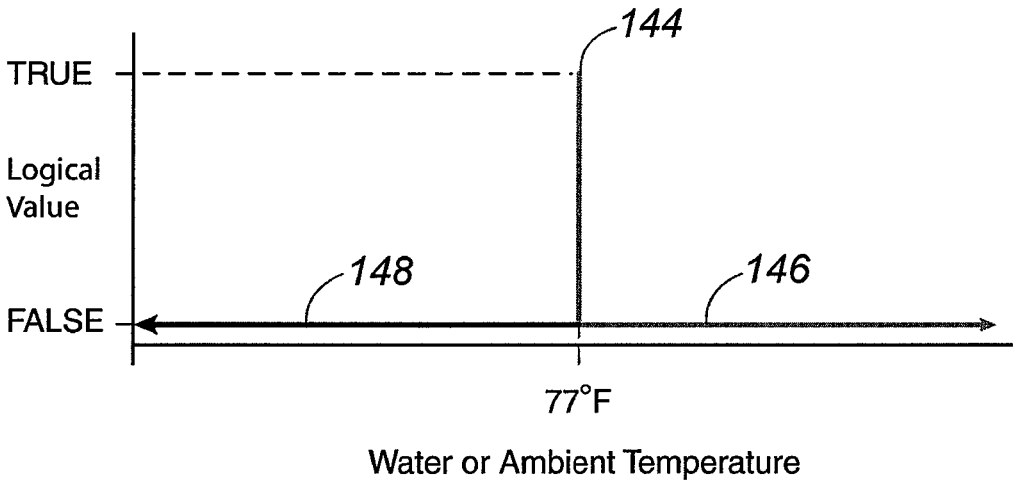
FIG. 12 is a Boolean logic graph constructed in accordance with an embodiment to the present invention assigning logical values to determine if the ambient or water temperature is at room temperature.

Once the various temperature parameters have been calculated in functional block 84, functional block 86 assigns logical values to these temperature parameters. For example, as illustrated in FIG. 9, a logical value of true is assigned for a water temperature value of less than or equal to 72° Fahrenheit as illustrated by segment 128, while water temperature values above 72° Fahrenheit produces an output value of false for the cold water temperature parameter as illustrated by segment 130. For the temperature parameter of whether the temperature readings are close, as illustrated in FIG. 10, a temperature difference of plus or minus 5° produces an output value of true as illustrated by segment 132, while a temperature difference than greater than this leads to a value of false illustrated by segments 134, 136. For the temperature parameter "far" a temperature difference of within plus or minus 10° produces an output value of false illustrated by segment 138, while a temperature difference of greater than this leads to a value of true illustrated by segments 140, 142 of FIG. 11. FIG. 12 illustrates the assignment of logical values to the temperature parameter "room temperature". As illustrated in this graph, a temperature value of 77° leads to a value of true illustrated by point 144, while all other temperatures lead to a value of false illustrated by segments 146, 148.

Once the logical values been assigned to the temperature parameters in functional block 86, functional block 88 applies the Boolean rules to determine the likelihood of a dry fire condition should at least one of the heating elements 20, 22 be energized before ending at block 90 to return this value to decision block 56 of FIG. 2.

In one embodiment, block 88 includes an examination that is made on the first power up of the control after leaving the factory. Over a 15 minute period, if the lower temperature drops below the initial lower temperature by greater than 5° Fahrenheit and the upper temperature drops by 5° Fahrenheit from the initial upper temperature, then dry fire equals false, else dry fire equals true. This rule can only determine if the tank is full, not empty. Therefore, if after this check the dry fire equals true, then additional tests must be performed in view of the limitation of the proceeding rule only being able to determine if the tank is full. These subsequent examinations are also made during each subsequent power up delay, which in one embodiment is two minutes. In such cases, the rules start by assuming that dry fire equals false.

First, if the two tank temperatures are within plus or minus 5° and they are less than or equal to 72° and if the ambient temperature differs from these by greater than plus or minus 10° then dry fire equals false, else dry fire equals true. This rule can only prove that the tank is full of cold water not that it is empty. Second, if dry fire equals false and if the two tank temperatures and the ambient temperature are all within plus or minus 5° Fahrenheit and if the setting temperature differs from them by plus or minus 10° Fahrenheit then dry fire equals true. This rule, however, can only prove that the tank is empty, not full. Third, if dry fire equals false and if the two tank temperatures differ by greater than plus or minus 10° Fahrenheit then dry fire equals true. This rule can only prove that the tank is half full, a dry fire, not that it is okay. Finally, if the upper temperature is between the setting and the setting minus the upper differential and if the lower temperature is between the setting and the setting minus the lower differential and if the room temperature differs from the two temperatures by greater than plus or minus 5° Fahrenheit then dry fire equals false else dry fire equals true. This rule only proves that the tank is full of warm water. It cannot prove if it is empty. Once these rules have been applied, the determination is returned to functional block 56 of FIG. 2.

As the proceeding makes clear, the above described embodiments are totally passive using only sensor inputs, the setting input, and possibility the controller's history to determine whether or not a dry fire condition is likely should at least one of the heating elements 20, 22 be energized. As such, no stressing of heating elements is performed as required by previous methods of detecting the presence of a dry fire condition. Both fuzzy logic and Boolean logic may be utilized to determining this likelihood recognizing that various definitions of temperature parameters as well as operating conditions exist in various installations of such an appliance. In either implementation, the methods provide a distinct advantage and enhanced lifetime of operation over previous methods that required energization of the heating elements before it could be determined whether a dry fire condition existed.

All references, including publications, patent applications, and patents cited herein are hereby incorporated by reference to the same extent as if each reference were individually and specifically indicated to be incorporated by reference and were set forth in its entirety herein.

The use of the terms "a" and "an" and "the" and similar referents in the context of describing the invention (especially in the context of the following claims) is to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

What is claimed is:

1. A method of preventing a dry fire condition in a liquid heating appliance having a tank in which liquid is heated by at least one electrical heating element, the appliance including at least one sensor required for normal operation thereof, comprising the steps of:

without energizing the at least one electrical heating element, reading the at least one sensor and determining whether a dry fire condition would occur if the heating element were energized based on the reading of the at least one sensor; and when the step of determining indicates that a dry fire condition is not likely, allowing energization of the at least one electrical heating element under normal control; and when the step of determining indicates that a dry fire condition is likely, disabling energization of the at least one electrical heating element for at least a period of time;

wherein the step of determining comprises the steps of:

calculating a temperature parameter from the reading of the at least one sensor;

characterizing the temperature parameter into a fuzzy value;

applying at least one fuzzy logic rule to the fuzzy value; and performing defuzzification of a result of the step of applying to determine if a dry fire condition is likely or not if energization of the at least one electrical heating element is permitted.

2. The method of claim 1, wherein the step of characterizing the temperature parameter comprises the steps of:

assigning a value of one when the temperature parameter is below approximately 67 degrees Fahrenheit;

assigning a value of zero when the temperature parameter is above approximately 78 degrees Fahrenheit; and assigning a value from zero to one when the temperature parameter is between approximately 78 degrees Fahrenheit and approximately 67 degrees Fahrenheit in accordance with a predefined function.

3. The method of claim 1, wherein the step of characterizing the temperature parameter comprises the steps of:

assigning a value of one when the temperature parameter is approximately equal to 77 degrees Fahrenheit;

assigning a value of zero when the temperature parameter is greater than approximately 87 degrees Fahrenheit or less than approximately 67 degrees Fahrenheit;

assigning a value from zero to one when the temperature parameter is greater than approximately 67 degrees Fahrenheit and less than approximately 77 degrees Fahrenheit in accordance with a first predefined function; and assigning a value from one to zero when the temperature parameter is greater than approximately 77 degrees Fahrenheit and less than approximately 87 degrees Fahrenheit in accordance with a second predefined function.

4. The method of claim 1, wherein the at least one sensor comprises two temperature sensors; wherein the step of calculating the temperature parameter comprises the step of calculating a delta temperature between readings from each of the two temperature sensors, and further comprising the steps of:

assigning a value of zero when the delta temperature is greater than or equal to approximately five degrees Fahrenheit;

assigning a value of one when the delta temperature is approximately equal to zero; and assigning a value from zero to one when the delta temperature is between approximately minus five degrees Fahrenheit and zero degrees Fahrenheit in accordance with a first predefined function; and assigning a value from one to zero when the delta temperature is between approximately zero degrees Fahrenheit and approximately five degrees Fahrenheit in accordance with a second predefined function.

5. The method of claim 1, wherein the at least one sensor comprises two temperature sensors; wherein the step of calculating the temperature parameter comprises the step of calculating a delta temperature between readings from each of the two temperature sensors, and further comprising the steps of:

assigning a value of one when the delta temperature is greater than or equal to approximately five degrees Fahrenheit;

assigning a value of zero when the delta temperature is approximately equal to zero; and assigning a value from one to zero when the delta temperature is between approximately minus five degrees Fahrenheit and zero degrees Fahrenheit in accordance with a first predefined function; and assigning a value from zero to one when the delta temperature is between approximately zero degrees Fahrenheit and approximately five degrees Fahrenheit in accordance with a second predefined function.

6. A method of preventing a dry fire condition in a liquid heating appliance having a tank in which liquid is heated by at least one electrical heating element, the appliance including at least one sensor required for normal operation thereof, comprising the steps of:

without energizing the at least one electrical heating element, reading the at least one sensor and determining whether a dry fire condition would occur if the heating element were energized based on the reading of the at least one sensor; and when the step of determining indicates that a dry fire condition is not likely, allowing energization of the at least one electrical heating element under normal control; and when the step of determining indicates that a dry fire condition is likely, disabling energization of the at least one electrical heating element for at least a period of time;

wherein the step of determining comprises the steps of:

calculating a temperature parameter from the reading of the at least one sensor;

assigning logical values to the temperature parameter; and applying at least one Boolean logic rule to the logical value to determine if a dry fire condition is likely or not if energization of the at least one electrical heating element is permitted.

7. The method of claim 6, wherein the step of assigning logical values comprises the steps of:

assigning a logical true when the temperature parameter is less than approximately 72 degrees Fahrenheit; and assigning a logical false when the temperature parameter is greater than approximately 72 degrees Fahrenheit.

8. The method of claim 6, wherein the step of assigning logical values comprises the steps of:

assigning a logical true when the temperature parameter is equal to approximately 77 degrees Fahrenheit; and assigning a logical false when the temperature parameter is not equal to approximately 77 degrees Fahrenheit.

9. The method of claim 6, wherein the at least one sensor comprises two temperature sensors; wherein the step of calculating the temperature parameter comprises the step of calculating a delta temperature between readings from each of the two temperature sensors, and further comprising the steps of:

assigning a logical true when the delta temperature is between approximately negative five degrees Fahrenheit and approximately five degrees Fahrenheit;

assigning a logical false when the delta temperature is greater than approximately five degrees Fahrenheit; and assigning a logical false when the delta temperature is less than approximately negative five degrees Fahrenheit.

10. The method of claim 6, wherein the at least one sensor comprises two temperature sensors; wherein the step of calculating the temperature parameter comprises the step of calculating a delta temperature between readings from each of the two temperature sensors, and further comprising the steps of:

assigning a logical false when the delta temperature is between approximately negative five degrees Fahrenheit and approximately five degrees Fahrenheit;

assigning a logical true when the delta temperature is greater than approximately five degrees Fahrenheit; and assigning a logical true when the delta temperature is less than approximately negative five degrees Fahrenheit.

* * * * *